US006310025B1

(12) United States Patent
Del Duca et al.

(10) Patent No.: US 6,310,025 B1
(45) **Date of Patent: *Oct. 30, 2001**

(54) LAUNDRY PRETREATMENT PROCESS AND BLEACHING COMPOSITIONS

(75) Inventors: Valerio Del Duca, Massa Lubrense; Valentina Masotti, Casalecchio di Reno; Stefano Scialla, Rome, all of (IT)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/142,395

(22) PCT Filed: Feb. 26, 1997

(86) PCT No.: PCT/US97/03238

§ 371 Date: Sep. 4, 1998

§ 102(e) Date: Sep. 4, 1998

(87) PCT Pub. No.: WO97/32962

PCT Pub. Date: Sep. 12, 1997

Related U.S. Application Data

(63) Continuation-in-part of application No. 08/663,501, filed on Jun. 14, 1996, now Pat. No. 5,759,439.

(30) Foreign Application Priority Data

| | | |
|---|---|---|
| Mar. 4, 1996 | (EP) | 96870023 |
| Jul. 24, 1996 | (EP) | 96202104 |
| Jul. 31, 1996 | (EP) | 96202168 |
| Sep. 13, 1996 | (EP) | 96870116 |

(51) Int. Cl.[7] ..... C11D 3/395; C11D 3/37

(52) U.S. Cl. ..... 510/283; 510/299; 510/303; 510/309; 510/372; 510/475

(58) Field of Search ..... 510/283, 284, 510/299, 303, 309, 372, 312, 313, 360, 375, 376, 417, 475, 499, 506, 528; 8/111; 252/186.38, 186.42, 186.43

(56) References Cited

U.S. PATENT DOCUMENTS

| | | | | |
|---|---|---|---|---|
| 2,182,306 | | 12/1939 | Ulrich et al. | 548/967 |
| 4,131,562 | | 12/1978 | Lutz et al. | 252/186.31 |
| 4,561,991 | * | 12/1985 | Herbots et al. | 510/283 |
| 4,563,186 | * | 1/1986 | Flynn et al. | 8/137 |
| 4,891,160 | | 1/1990 | Vander Meer | 510/350 |
| 4,909,962 | * | 3/1990 | Clark et al. | 510/283 |
| 4,931,063 | * | 6/1990 | Wilsberg et al. | 510/283 |
| 5,445,651 | | 8/1995 | Thoen et al. | 8/111 |
| 5,478,489 | | 12/1995 | Fredj et al. | 510/299 |
| 5,759,439 | * | 6/1998 | Kott et al. | 510/309 |
| 5,905,065 | * | 5/1999 | Scialla et al. | 510/280 |

FOREIGN PATENT DOCUMENTS

| | | | |
|---|---|---|---|
| 51055479 | 5/1976 | (JP) | D96L/001/06 |

* cited by examiner

*Primary Examiner*—John Hardee
(74) *Attorney, Agent, or Firm*—Donald E. Hasse; Brian M. Bolam; Kim W. Zerby

(57) ABSTRACT

The present invention relates to a process for pretreating soiled fabrics with a liquid composition comprising a peroxygen bleach and a soil dispersing agent selected from the group consisting of an ethoxylated monoamine, an ethoxylated diamine, and ethoxylated polyamine, an ethoxylated amine polymer and mixtures thereof. This invention also discloses liquid compositions suitable for pretreating fabrics, comprising a peroxygen bleach, a surfactant, and a soil dispersing agent selected from the group consisting of an ethoxylated monoamine, an ethoxylated diamine, an ethoxylated polyamine, an ethoxylated amine polymer and mixtures thereof, said composition being formulated either as an emulsion or a microemulsion.

14 Claims, No Drawings

LAUNDRY PRETREATMENT PROCESS AND BLEACHING COMPOSITIONS

This Application is a continuation-in-part of U.S. application Ser. No. 08/663,501, filed Jun. 14, 1996, now U.S. Pat. No. 5,759,439, dated Jun. 2, 1998.

TECHNICAL FIELD

The present invention relates to bleaching compositions particularly suitable to be used as a pretreater and to a process of pretreating fabrics.

BACKGROUND

A great variety of cleaning compositions have been described in the art, that are particularly suitable for pretreating fabrics.

For instance, EP-A-598170 discloses a particular type of cleaning compositions which are aqueous emulsions of a nonionic surfactant system further comprising hydrogen peroxide or water-soluble source thereof and a liquid bleach activator, or any other hydrophobic ingredient which needs to be separated from said hydrogen peroxide.

European patent application number 95203330.6 discloses a particular type of cleaning compositions which are aqueous microemulsions of a bleach activator in a matrix comprising water, hydrogen peroxide and a hydrophilic surfactant system.

However, a drawback associated with such emulsions or microemulsions comprising a peroxygen bleach and a bleach activator, especially when used in laundry pretreatment applications on different kinds of fabrics, e.g., cotton and/or synthetic fabrics (e.g., polyester/polyamides), is that they do not deliver effective performance which satisfactorily meet consumer's needs on all types of stains including greasy stains, enzymatic stains, mud/clay stains as well as bleachable stains. Indeed, there is still some room to further improve the stain removal performance as well as the bleaching performance of such bleach-containing compositions when pretreating a fabric therewith.

It is thus an object of the present invention to provide improved stain removal performance on a wide range of stains as well as improved bleaching performance, especially under laundry pretreatment conditions, i.e., when applied neat onto at least a portion of a fabric before washing said fabric.

Furthermore, another problem associated with such emulsions and/or microemulsions especially with those containing relatively high concentration of surfactants, e.g., about 8% or above, is that important viscosity tends to build up, which makes said emulsions/microemulsions difficult to dispense, and thus unacceptable from a consumer viewpoint.

It is thus a further object of the present invention to provide liquid emulsions or microemulsions comprising a peroxygen bleach and a surfactant wherein the viscosity can be conveniently controlled while maintaining adequate physical stability.

It has now been found that improved stain removal performance is obtained, by using a liquid composition comprising a peroxygen bleach and a soil dispersing agent selected from the group consisting of an ethoxylated monoamine, an ethoxylated diamine, an ethoxylated polyamine, an ethoxylated amine polymer and mixture thereof, as described hereinafter, to pretreat soiled fabrics. Indeed, the addition of such a soil dispersing agent, in a liquid composition comprising a peroxygen bleach, and optionally a bleach activator, delivers improved stain removal performance on various types of stains including greasy stains, enzymatic stains, clay/mud stains, and the like, under pretreatment conditions, as compared to the stain removal performance delivered by the same composition without said soil dispersing agent. Also, it has surprisingly been found that the liquid compositions comprising both the peroxygen bleach and said soil dispersing agent, when used to pretreat fabrics, provide improved bleaching efficacy, as compared to the same compositions without said soil dispersing agent. Thus, it has been found that the addition of a single compound, i.e., such a soil dispersing agent, in a peroxygen bleach-containing composition, delivers both improved stain removal performance and improved bleaching performance. Furthermore, it has been found that this improved stain removal performance on various stains is maintained even for peroxygen bleach-containing compositions having undergone long storage time. It is thus speculated that the oxidized form of the soil suspeding agent that may have formed in the presence of a peroxygen bleach under long storage time and/or elevated temperature still provides improved stain removal performance on various types of stains. Thus, in its broadest aspect, the present invention encompasses a process for bleaching a fabric with a liquid composition comprising from 0.01% to 15% by weight of the total composition of a peroxygen bleach, and a soil dispersing agent, said process comprising the steps of applying said liquid composition in its neat form onto at least one portion of said fabric, optionally allowing said composition to remain in contact with said fabric and then washing said fabric.

Furthermore, it has been found that the addition of a soil dispersing agent selected from the group consisting of an ethoxylated monoamine, an ethoxylated diamine, an ethoxylated polyamine, an ethoxylated amine polymer and mixture thereof, in a liquid composition formulated either as an emulsion or microemulsion, comprising a peroxygen bleach and a surfactant, reduces the viscosity of said composition, whatever the viscosity was before the addition of said soil dispersing agent. Actually, an advantage of the liquid compositions of the present invention formulated either as an emulsion or a microemulsion, is that they deliver improved stain removal performance and improved bleaching performance while delivering acceptable viscosity, without the need to add viscosity control agents. In other words, the present invention allows to formulate emulsions or microemulsions with improved overall stain removal/bleaching performance and desirable physical characteristics at reduced costs, i.e., without adding any viscosity control agent that would raise the cost formula and bulk to the compositions without contributing to the bleaching/cleaning performance of said compositions.

Another advantage of the present invention is that stable liquid emulsions or microemulsions are provided that are suitable to be used in the most efficient manner by the consumer over prolonged period of time.

Yet another advantage of the compositions according to the present invention which are formulated as emulsions or microemulsions is that they provide also excellent cleaning and/or bleaching performance when used in applications other than laundry pretreaters, such as in other laundry applications, as laundry detergents or laundry additives.

European patent application number 95870079.1 discloses laundry compositions suitable for pretreating fabrics comprising polyamines and peroxygen bleach. No ethoxylated amines, ethoxylated polyamines or ethoxylated amine polymers are disclosed.

U.S. application Ser. No. 08/663501 discloses pretreater compositions with particular chelants, a peroxygen bleach, and optional ingredients like bleach activators, polymeric soil releasing agents like sulfonated poly-ethoxy/propoxy end-capped ester oligomer. However, no ethoxylated amines, ethoxylated polyamines, or ethoxylated amine polymers are disclosed.

EP-A-271 312 discloses laundry compositions comprising a peroxyacid bleach and a soil release agent like particular alkyl and hydroxyalkyl ethers of cellulose, polymers comprising ethylene terephthalate and polyethylene oxide terephthalate. No ethoxylated amines, ethoxylated polyamines or ethoxylated amine polymers are disclosed.

WO96/12004 discloses laundry compositions comprising a lipophilic enzyme ana a primary and/or tertiary amine. These compositions provide enhanced cleaning of greasy/oily soils and stains, particularly when used in pretreatment laundering process for cleaning fabrics stained with greasy soils. The compositions exemplified comprise tetraethylenepentamine ethoxylated (15–18) but no bleach.

EP-A-112 593 discloses detergent compositions (pH=6 to 8.5) comprising ethoxylated mono- or diamines, ethoxylated polyamines and/or ethoxylated amine polymers as a clay soil removal/antiredeposition agent. Said compositions may be used in laundry pretreatment application. No peroxygen bleaches are disclosed.

SUMMARY OF THE INVENTION

The present invention encompasses a process of bleaching a fabric with a liquid composition comprising from 0.01% to 15% by weight of the total composition of a peroxygen bleach, and a soil dispersing agent selected from the group consisting of (1) ethoxylated monoamines having the formula:

$$(X—L—)—N—(R^2)_2$$

(2) ethoxylated diamines having the formula:

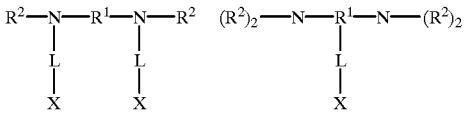

or $$(X—L—)_2—N—R^1—N—(R^2)_2$$

(3) ethoxylated polyamines having the formula:

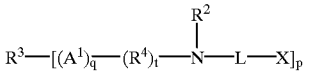

(4) ethoxylated amine polymers having the general formula:

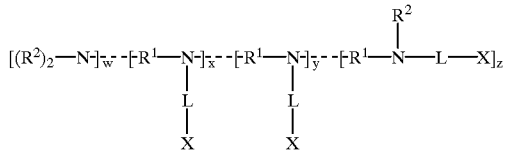

and (5) mixtures thereof,

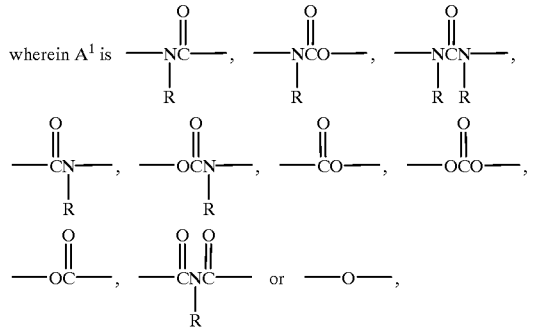

R is H or $C_1$–$C_4$ alkyl or hydroxyalkyl; R1 is $C_2$–$C_{12}$ alkylene, hydroxyalkylene, alkenylene, arylene or alkarylene, or a $C_2$–$C_3$ oxyalkylene moiety having from 2 to 20 oxyalkylene units provided that no O—N bonds are formed; each $R^2$ is $C_1$–$C_4$ alkyl or hydroxyalkyl, the moiety —L—X, or two $R^2$ together form the moiety $—(CH_2)_r—A^2—(CH_2)_s—$, wherein $A^2$ is —O — or $—CH_2—$, r is 1 or 2, s is 1 or 2, and r+s is 3 or 4; X is a nonionic group, an anionic group or mixture thereof; $R^3$ is substituted $C_3$–$C_{12}$ alkyl, hydroxyalkyl, alkenyl, aryl, or alkaryl group having p substitution sites; $R^4$ is $C_1$–$C_{12}$ alkylene, hydroxyalkylene, alkenylene, arylene or alkarylene, or a $C_2$–$C_3$ oxyalkylene moiety have from 2 to 20 oxyalkylene units provided that no O—O — or O—N bonds are formed; L is a hydrophilic chain which contains the polyoxyalkylene moiety $—[(R^5O)_m(CH_2CH_2O)_n]—$, wherein $R^5$ is $C_3$–$C_4$ alkylene or hydroxyalkylene and m and n are numbers such that the moiety $—(CH_2CH_2O)_n—$ comprises at least 50% by weight of said polyoxyalkylene moiety; for said monoamines, m is from 0 to 4, and n is at least 12; for said diamines, m is from 0 to 3, and n is at least 6 when $R^1$ is $C_2$–$C_3$ alkylene hydroxyalkylene, or alkenylene, and at least 3 when $R^1$ is other than $C_2$–$C_3$ alkylene, hydroxyalkylene or alkenylene; for said polyamines and amine polymers, m is from 0 to 10 and n is at least 3; p is from 3 to 8; q is 1 or 0; t is 1 or 0, provided that t is 1 when q is 1; w is 1 or 0; x+y+z is at least 2; and y+z is at least 2, said process comprising the steps of applying said composition in its neat form onto at least a portion of said fabric, before said fabric is washed.

The present invention encompasses a liquid composition suitable for pretreating fabrics, comprising a peroxygen bleach, a surfactant and a soil dispersing agent selected from the group consisting of an ethoxylated monoamine, an ethoxylated diamine, an ethoxylated polyamine, an ethoxylated amine polymers and mixture thereof as previously defined, said composition being formulated either as an emulsion or a microemulsion.

DETAILED DESCRIPTION OF THE INVENTION

The Laundry Pretreatment Process

In its broadest embodiment, the present invention relates to a process of pretreating a fabric with a liquid composition comprising a soil dispersing agent, as defined herein, and from 0.01% to 15% by weight of the total composition of a peroxygen bleach.

By "pretreating a fabric" it is to be understood that the liquid composition herein is applied in its neat form onto at least a portion of a soiled fabric, optionally left to act onto said fabric typically for a period of time of 1 minute t o several hours, before said fabric is washed, as described hereinafter, in the process of bleaching fabrics according to the present invention.

Indeed, the present invention is based on the finding that by adding a soil dispersing agent, as described herein, in a liquid composition comprising a peroxygen bleach, improved stain removal performance is obtained with said composition when used to pretreat a soiled fabric before said fabric is washed, as compared to the stain removal performance delivered with the same composition without said soil dispersing agent.

By "stain removal performance" it is meant herein stain removal performance on a variety of stains/soils such as greasy/oily stains, and/or enzymatic stains and/or mud/clay stains as well as bleachable stains.

By "greasy/oily stains" it is meant herein any soil and stain of greasy nature that can be found on a fabric like dirty motor oil, mineral oil, make-up, lipstick vegetal oil, spaghetti sauce, mayonnaise and the like.

Examples of bleachable stains include tea, coffee, wine and the like. Examples of enzymatic stains include grass, chocolate and blood.

The stain removal performance of a given composition on a soiled fabric under pretreatment conditions, may be evaluated by the following test method. A composition according to the present invention is first applied to the stained portion of said fabric, left to act from about 1 to about 10 minutes, typically 5 minutes, and said pretreated fabric is then washed according to common washing conditions with a conventional detergent composition, at a temperature of from 30° C. to 70° C. for a period of time sufficient to bleach said fabric. For example, typical soiled fabrics to be used in this stain removal performance test method may be commercially available from EMC (Empirical Manufacturing Company) Cincinnati, Ohio, USA such as clay, chocolate, spaghetti sauce, dirty motor oil, make-up, tea, coffee, blood on two different substrate/fabric, e.g., cotton (CW120) and polycotton (PCW28).

The stain removal performance may then be evaluated by comparing side by side the soiled fabric pretreated with the composition according to the present invention with those pretreated with the reference, e.g., the same composition without such a soil dispersing a gent according to the present invention. A visual grading scale may be used to assign differences in panel score units (psu), in a range from 0 to 4.

Accordingly, the present invention encompasses a process of bleaching a fabric with a liquid composition comprising from 0.01% to 15% by weight of the total composition of a peroxygen bleach and a soil dispersing agent, as defined herein, said process comprises the steps of applying said composition in its neat form onto at least a portion of said fabric, optionally allowing said composition to remain in contact with said fabric preferably without leaving said composition to dry onto said fabric, before said fabric is washed.

Said composition may remain in contact with said fabric, typically for a period of 1 minute to several hours, preferably 1 minute to 1 hour, more preferably 1 minute to 30 minutes, and most preferably 2 to 10 minutes. Optionally, when the fabric is soiled with encrusted stains/soils which otherwise would be relatively difficult to remove, said composition may be rubbed and/or brushed more or less intensively, for example, by means of a sponge or a brush or simply by rubbing two pieces of fabric each against the other.

By "washing" it is to be understood herein to simply rinse the fabric with water, or the fabric may be washed with a conventional composition comprising at least one surface active agent, this by the means of a washing machine o r simply by hand.

By "sin its neat form" it is to be understood that the liquid compositions are applied directly onto the fabrics to be pre-treated without undergoing any dilution, e.g., the liquid compositions according to the present invention are applied as described herein.

According to the process of pretreating soiled fabrics of the present invention, the liquid compositions used in said process should preferably not be left to dry onto the fabrics. Indeed, it has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation contributes to generate peroxy-radicals which may cause color damage and/or fabric damage. Thus, not leaving the liquid bleaching compositions used according to the present invention to dry onto the fabrics, in the process of bleaching fabrics according to the present invention would result in a safer pretreating operation with liquid bleaching compositions.

As an essential element the compositions to be used according to the present invention comprise a peroxygen bleach or mixtures thereof.

The peroxygen bleach to be used herein is any peroxygen bleach, known to those skilled in the art. Such peroxygen bleach includes hydrogen peroxide, or a water-soluble source thereof, or mixtures thereof. Indeed, the presence of the peroxygen bleach contributes to the excellent cleaning and bleaching benefits of the compositions used according to the present invention. As used herein a hydrogen peroxide source refers to any compound which produces perhydroxyl ions when said compound is in contact with water.

Suitable water-soluble sources of hydrogen peroxide for use herein include percarbonates, persilicate, persulphate such as monopersulfate, perborates, peroxyacids such as diperoxydodecandioic acid (DPDA), magnesium perphtalic acid, perlauric acid, perbenzoic and alkylperbenzoic acids, hydroperoxides, diacyl peroxides and mixtures thereof. Preferred peroxygen bleaches used herein are hydrogen peroxide, hydroperoxide and/or aliphatic diacyl peroxide.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide. Such hydroperoxides have the advantage to be particularly safe to fabrics and color while delivering excellent bleaching performance.

Suitable aliphatic diacyl peroxides for use herein are dilauroyl peroxide, didecanoyl peroxide, dimyristoyl peroxide or mixtures thereof. Such aliphatic diacyl peroxides have the advantage to be particularly safe to fabrics and color while delivering excellent bleaching performance.

The compositions used according to the present invention comprise from 0.01% to 1 5% by weight of the total composition of such a peroxygen bleach or mixtures thereof, preferably from 0.1% to 12%, more preferably from 0.5% to 10% and most preferably from 2% to 8%.

As an essential element the compositions to be used according to the present invention comprise a soil dispersing agent selected from the group consisting of ethoxylated monoamines, ethoxylated diamines, ethoxylated polyamines, ethoxylated amine polymers, as previously defined and mixtures thereof. Indeed, the presence of said soil dispersing agent contributes to the excellent cleaning and bleaching benefits of the compositions used according to the present invention.

In the preceding formulas of the soil dispersing agent used herein, $R^1$ can be branched

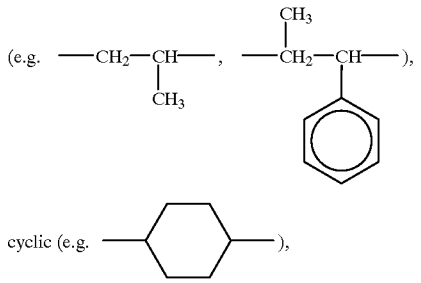

or most preferably linear

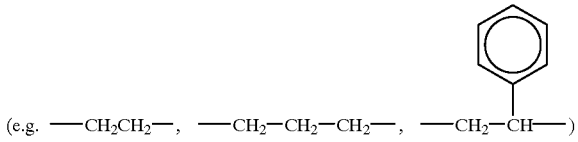

alkylene, hydroxyalkylene, alkenylene, alkarylene or oxyalkylene. $R^1$ is preferably $C_2$–$C_6$ alkylene for the ethoxylated diamines and amine polymers. For the ethoxylated diamines, the minimum degree of ethoxylation required for suitable soil removal/anti-redeposition properties decreases on going from $C_2$–$C_3$ alkylene (ethylene, propylene) to hexamethylene. However, for the ethoxylated amine polymers, in particular the ethoxylated polyalkyleneamines and polyalkyleneimines, especially at higher molecular weights, $C_2$–$C_3$ alkylene (ethylene, propylene) are preferred for $R^1$ with ethylene being most preferred. Each $R^2$ is preferably the moiety —L—X.

In the preceding formulas, hydrophilic chain L usually consists entirely of the polyoxyalkylene moiety $—[(R^5O)_m(CH_2CH_2—O)_n]$. The moieties $—(R^5O)_m—$ and $—(CH_2CH_2O)_n—$ of the polyoxyalkylene moiety can be mixed together or preferably form blocks of $—(R^5O)_m—$ and $—(CH_2CH_2O)_n—$ moieties. $R^5$ is preferably $C_3H_6$ (propylene). For the ethoxylated polyamines and amine polymers, m is preferably from 0 to 5. For all ethoxylated amines of the present invention, m is most preferably 0, i.e. the polyoxyalkylene moiety consists entirely of the moiety $—(CH_2CH_2O)_n—$. The moiety $—(CH_2CH_2O)_n—$ preferably comprises at least 85% by weight of the polyoxyalkylene moiety and most preferably 100% by weight (m is O).

In the preceding formula, X can be any compatible nonionic group, anionic group or mixture thereof. Suitable nonionic groups include $C_1$–$C_4$ alkyl or hydroxyalkyl ester or ether groups, preferably acetate or methyl ether, respectively; hydrogen (H); or mixtures thereof. The particularly preferred nonionic group is H. With regard to anionic groups, $PO_3^{-2}$ and $SO_3^-$ are suitable. The particularly preferred anionic group is $SO_3^-$. It has been found that the percentage of anionic groups relative to nonionic groups can be important to the soil removal/anti-redeposition properties provided by the ethoxylated amine. A mixture of from 0 to 30% anionic groups and from 70 to 100% nonionic groups provides preferred properties. A mixture of from 5 to 10% anionic groups and from 90 to 95% nonionic groups provides the most preferred properties. Usually, a mixture of from 0 to 80% anionic groups and from 20 to 100% nonionic groups provides suitable soil removal/anti-redeposition properties.

Preferred ethoxylated mono- and diamines have the formula:

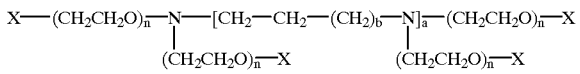

wherein X and n are defined as before, a is 0 or 1 and b is from 0 to 4. For preferred ethoxylated monoamines (a=0), n is at least 15, with a typical range of from 15 to 35. For preferred ethoxylated diamines (a=1), n is at least 12 with a typical range of from 12 to 42.

Methods for making ethoxylated amines are for example described in EP-A-112 593.

In the preceding formula for the ethoxylated polyamines, $R^3$ (linear, branched, or cyclic) is preferably a substituted $C_3$–$C_6$ alkyl, hydroxyalkyl or aryl group; $A^1$ is preferably

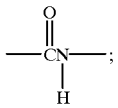

n is preferably at least 12, with a typical range of from 12 to 42; p is preferably from 3 to 6. When $R^3$ is a substituted aryl or alkaryl group, q is preferably 1 and $R^4$ is preferably $C_2$–$C_3$ alkylene. When $R^3$ is an alkyl, hydroxyalkyl, or alkenyl group, and when q is 0, $R^1$ is preferably a $C_2$–$C_3$ oxyalkylene moiety; when q is 1, $R^4$ is preferably $C_2$–$C_3$ alkylene.

These ethoxylated polyamines can be derived from polyamino amides such as:

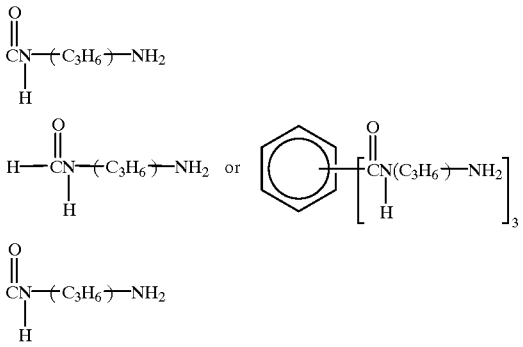

These ethoxylated polyamines can also be derived from polyaminopropylene-oxide derivatives such as:

$—OC_3H_6)_c—NH_2$ $CH_3—(OC_3H_6)_{c—NH2}$ $—(OC_3H_6)_c—NH_2$ wherein each c is a number from 2 to 20.

Preferred ethoxylated amine polymers are the ethoxylated $C_2$–$C_3$ polyalkyleneamines and polyalkyleneimines Particularly preferred ethoxylated polyalkyleneamines and polyalkyleneimines are the ethoxylated polyethyleneamines (PEA's) and polyethyleneimines (PEI's). These preferred compounds comprise units having the general formula:

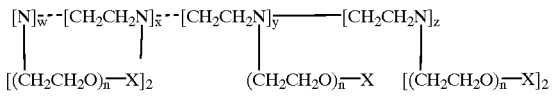

wherein X, w, x, y, z and n are defined as before.

Prior to ethoxylation, the PEAs used in preparing compounds of the present invention have the following general formula:

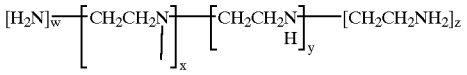

wherein x+y+z is from 2 to 9, y+z is from 2 to 9 and w is 0 or 1 (molecular weight of from 100 to 400). Each hydrogen atom attached to each nitrogen atom represents an active site for subsequent ethoxylation. For preferred PEAs, y+z is from 3 to 7 (molecular weight of from 140 to 310) and most prefarably from 3 to 4 (molecular weight of from 140 to 200). These PEA's can be obtained by reactions involving ammonia and ethylene dichloride, followed by fractional distillation. The common PEA's obtained are triethylenetetramine (TETA) and tetraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372 to Dickson, issued May 14, 1957, which describes the preparation of PEAs.

The minimum degree of ethoxylation required for preferred soil removal/anti-redeposition performance can vary depending upon the number of units in the PEA. Where y+z is 2 or 3, n is preferably at least about 6. Where y+z is from 4 to 9, suitable benefits are achieved when n is at least 3. For most preferred ethoxylated PEAs, n is at least 12, with a typical range of from 12 to 42.

The PEIs used in preparing the compounds of the present invention have a molecular weight of at least 440 prior to ethoxylation, which represents at least 10 units. Preferred PEIs used in preparing these compounds have a molecular weight of from 600 to 1800. The polymer backbone of these PEIs can be represented by the general formula:

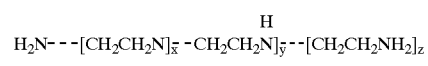

wherein the sum of x, y, and z represents a number of sufficient magnitude to yield a polymer having the molecular weights previously specified. Although linear polymer backbones are possible, branch chains can also occur. The relative proportions of primary, secondary and tertiary amine groups present in the polymer can vary, depending on the manner of preparation. The distribution of amine groups is typically as follows:

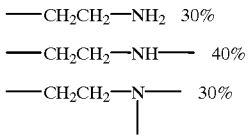

Each hydrogen atom attached to each nitrogen atom of the PEI represents an active site for subsequent ethoxylation. These PEIs can be prepared, for example, by polymerizing ethyleneimine in the presence of a catalyst such as carbon dioxide, sodium bisulfite, sulfuric acid, hydrogen peroxide, hydrochloric acid or acetic acid. Specific methods for preparing PEIs are disclosed in U.S. Pat. No. 2,182,306 to Ulrich et al., issued Dec. 5, 1939; U.S. Pat. No. 3,033,746 to Mayle et al., issued May 8, 1962; U.S. Pat. No. 2,208,095 to Esselmann et al., issued Jul. 16, 1940; U.S. Pat. No. 2,806,839 to Crowther, issued Sep. 17, 1957; and U.S. Pat. No. 2,553,696 to Wilson, issued May. 21, 1951.

As defined in the preceding formulas, n is at least 3 for the ethoxylated PEIs. However, it should be noted that the minimum degree of ethoxylation required for suitable soil removal/anti-redeposition performance can increase as the molecular weight of the PEI increases, especially much beyond 1800. Also, the degree of ethoxylation for preferred compounds increases as the molecular weight of the PEI increases. For PEIs having a molecular weight of at least 600, n is preferably at least 12, with a typical range of from 12 to 42. For PEIs having a molecular weight of at least 1800, n is preferably at least 24, with a typical range of from 24 to 42.

Typically, the compositions used according to the present invention comprise from 0.01% to 20% by weight of the total composition of such a soil dispersing agent or mixtures thereof, preferably from 0.1% to 10%, more preferably 0.2% to 4% and most preferably from 0.5% to 2%.

The liquid compositions used according to the process of the present invention are preferably aqueous compositions. The compositions used in the process herein have a pH of from 0 to 6, preferably from 1 to 5, and more preferably from 2 to 5 and most preferably from 3 to 5. Acidic compositions are preferred herein for stability reasons.

The compositions used according to the present invention may comprise optional ingredients like bleach activators, surfactants, perfumes, brighteners, chelating agents, radical scavengers, stabilisers, soil suspenders, dye transfer agents, solvents, dyes, other amines, or mixtures thereof. Preferred optional ingredients are further described in more details hereinafter.

The compositions

The present invention also encompasses a liquid composition suitable for pretreating fabrics, comprising a peroxygen bleach, a soil dispersing agent selected from the group consisting of an ethoxylated monoamine, an ethoxylated diamine, an ethoxylated polyamine, an ethoxylated amine polymer and mixture thereof, as defined hereinbefore, and a surfactant, said composition being formulated either as an emulsion or a microemulsion.

It is by adding such a soil dispersing agent in a liquid composition comprising a peroxygen bleach, a surfactant and being formulated either as an emulsion or a microemulsion, that not only improved stain removal performance is obtained especially under pretreatment conditions, on various stains including greasy stains, enzymatic stains, clay/mud stains as well as improved bleaching performance but also desirable viscosity is achieved.

It has now been found that the soil dispersing agents according to the present invention are easily processed in a composition being formulated either as an emulsion or a microemulsion, while providing the appropriate viscosity, i.e., the viscosity of said composition is reduced, whatever the viscosity was before the addition of said soil dispersing agents into said composition comprising a peroxygen bleach and a surfactant.

Any surfactant or a mixture thereof known to those skilled in the art are suitable to be used in the compositions of the present invention being formulated either as an emulsion or a microemulsion including anionic, nonionic, cationic, amphotheric, zwitternionic surfactants at a level of from 0.01% to 50% by weight of the total composition, preferably from 1% to 30%, and more preferably from 2% to 20%. Preferably a surfactant system is used in the compositions according to the present invention comprising at least one hydrophilic surfactant and at least one hydrophobic surfactant. Said two surfactants in order to form emulsions or microemulsions which are stable preferably have different HLB values (hydrophilic lipophilic balance) and typically the difference in value of the HLBs of said two surfactants is at least 1, preferably at least 2 and most preferably at least 3.

By "hydrophobic surfactant" it is meant herein a surfactant having an HLB up to 10 or mixtures thereof, preferably below 10, more preferably below 9. Indeed, the hydrophobic surfactants to be used herein have excellent grease cutting properties, i.e., they have a solvent effect which contributes to hydrophobic soil removal.

By "hydrophilic surfactant" it is meant herein a surfactant having an HLB above 10 or mixtures thereof, preferably above 10.5, and more preferably above 11.

Typically, the compositions according to the present invention formulated either as an emulsion or a microemulsion comprise from 1% to 50% by weight of the total composition of said hydrophilic and hydrophobic surfactants, more preferably from 5% to 40% and most preferably from 8% to 30%. The preferred compositions according to the present invention comprise at least from 0.01% by weight of the total composition of said hydrophobic surfactant, or mixtures thereof, preferably at least 2% and more preferably at least 4% and at least from 0.01% by weight of the total composition of said hydrophilic surfactant, or mixtures thereof, preferably at least 2%, and more preferably at least 4%.

Accordingly, particularly preferred surfactants to be used in the compositions according to the present invention are nonionic surfactants. Indeed, suitable nonionic surfactants for use herein include alkoxylated fatty alcohols preferably, fatty alcohol ethoxylates and/or propoxylates. Indeed, a great variety of such alkoxylated fatty alcohols are commercially available which have very different HLB values (hydrophilic/lipophilic balance). The HLB values of such alkoxylated nonionic surfactants depend essentially on the chain length of the fatty alcohol, the nature of the alkoxylation and the degree of alkoxylation. Hydrophilic nonionic surfactants tend to have a high degree of alkoxylation and a short chain fatty alcohol, while hydrophobic surfactants tend to have a low degree of alkoxylation and a long chain fatty alcohol. Surfactant catalogs are available which list a number of surfactants including nonionics, together with their respective HLB values.

Suitable chemical processes for preparing the nonionic surfactants for use herein include condensation of corresponding alcohols with alkylene oxide, in the desired proportions. Such processes are well-known to the man skilled in the art and have been extensively described in the art. As an alternative, a great variety of alkoxylated alcohols suitable for use herein is commercially available from various suppliers.

Preferred hydrophobic nonionic surfactants to be used in the compositions according to the present invention are surfactants having an HLB up to 10 and being according to the formula $RO—(C_2H_4O)_n(C_3H_6O)_mH$, wherein R is a $C_6$ to $C_{22}$ alkyl chain or a $C_6$ to $C_{28}$ alkyl benzene chain, and wherein n+m is from 0.5 to 5 and n is from 0 to 5 and m is from 0 to 5 and preferably n+m is from 0.5 to 4.5 and, n and m are from 0 to 4.5. The preferred R chains for use herein are the $C_8$ to $C_{22}$ alkyl chains. Accordingly, suitable hydrophobic nonionic surfactants for use herein are Dobanol$^R$ 91-2.5 (HLB=8.1; R is a mixture of $C_9$ and $C_{11}$ alkyl chains, n is 2.5 and m is 0), or Lutensol$^R$TO3 (HLB=8; R is a mixture of $C_{13}$ and $C_{15}$ alkyl chains, n is 3 and m is 0), or Tergitol$^R$ 25L3 (HLB=7.7; R is in the range of $C_{12}$ to $C_{15}$ alkyl chain length, n is 3 and m is 0), or Dobanol$^R$ 23-3 (HLB=8.1; R is a mixture of $C_{12}$ and $C_{13}$ alkyl chains, n is 3 and m is 0), or Dobanol$^R$ 23-2 (HLB=6.2; R is a mixture of $C_{12}$ and $C_{13}$ alkyl chains, n is 2 and m is 0), or mixtures thereof. Preferred herein are Dobanol$^R$ 23-3, or Dobanol$^R$ 23-2, Lutensol$^R$TO3, or mixtures thereof. These Dobanol$^R$ surfactants are commercially available from SHELL. These Lutensol$^R$ surfactants are commercially available from BASF and these Tergitol$^R$ surfactants are commercially available from UNION CARBIDE. Other suitable hydrophobic nonionic surfactants to be used herein are non alkoxylated surfactants. An example is Dobanol$^R$23 (HLB<3).

Preferred hydrophilic nonionic surfactants to be used in the compositions according to the present invention are surfactants having an HLB above 10 and being according to the formula $RO—(C_2H_4O)_n(C_3H_6O)_mH$, wherein R is a $C_6$ to $C_{22}$ alkyl chain or a $C_6$ to $C_{28}$ alkyl benzene chain, and wherein n+m is from 5 to 11 and n is from 0 to 11 and m is from 0 to 11, preferably n+m is from 6 to 10 and, n and m are from 0 to 10. Throughout this description n and m refer to the average degree of the ethoxylation/propoxylation. The preferred R chains for use herein are the $C_8$ to $C_{22}$ alkyl chains. Accordingly, suitable hydrophilic nonionic surfactants for use herein are Dobanol$^R$ 23-6.5 (HLB =11.9 ; R is a mixture of $C_{12}$ and $C_{13}$ alkyl chains, n is 6.5 and m is 0), or Dobanol$^R$ 25-7 (HLB=12 ; R is a mixture of $C_{12}$ to $C_{15}$ alkyl chains, n is 7 and m is 0), or Dobanol$^R$ 45-7 (HLB= 11.6 ; R is a mixture of $C_{14}$ and $C_{15}$ alkyl chains, n is 7 and m is 0), or Dobanol$^R$ 91-5 (HLB=11.6 ; R is a mixture of $C_9$ to $C_{11}$ alkyl chains, n is 5 and m is 0), or Dobanol$^R$ 91-6 (HLB=12.5 ; R is a mixture of $C_9$ to $C_{11}$ alkyl chains, n is 6 and m is 0), or Dobanol$^R$ 91-8 (HLB=13.7; R is a mixture of $C_9$ to $C_{11}$ alkyl chains, n is 8 and m is 0), or Dobanol$^R$ 91-10 (HLB=14.2 ; R is a mixture of $C_9$ to $C_{11}$ alkyl chains, n is 10 and m is 0), or mixtures thereof. Preferred herein are Dobanol$^R$ 91-10, or Dobanol$^R$ 45-7, Dobanol$^R$ 23–6.5, or mixtures thereof. These Dobanol$^R$ surfactants are commercially available from SHELL.

Apart from the hydrophilic nonionic surfactants other hydrophilic surfactants may further be used in the compositions of the present invention such as polyhydroxy fatty acid amide surfactants, or mixtures thereof, according to the formula $$R^2—C(O)—N(R^1)—Z,$$

wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilised as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2—(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2—(CHOH)_4—CH_2OH$.

In formula $R^2—C(O)—N(R^1)—Z$, $R^1$ can be, for example, N-methyl, N-ethyl, N-propyl, N-isopropyl, N-butyl, N-2-hydroxy ethyl, or N-2-hydroxy propyl. $R^2—C(O)—N<$ can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygaiactityl, 1-deoxymannityl, 1-deoxymaltotriotityl and the like.

Suitable polyhydroxy fatty acid amide surfactants to be used herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Other suitable hydrophilic surfactants to be used in the compositions herein include the anionic surfactants and mixtures thereof.

Suitable anionic surfactants to be used in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12}$–$C_{16}$ are preferred for lower wash temperatures (e.g., below about 50° C.) and $C_{16-C18}$ alkyl chains are preferred for higher wash temperatures (e.g., above about 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_8$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}$ $E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO\text{-}M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Other suitable anionic surfactants to be used herein also include acyl sarcosinate or mixtures thereof, in its acid and/or salt form, preferably long chain acyl sarcosinates having the following formula:

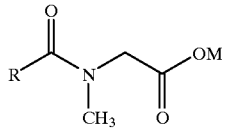

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, particularly preferred long chain acyl sarcosinates to be used herein include $C_{12}$ acyl sarcosinate (i.e. an acyl sarcosinate according to the above formula wherein M is hydrogen and R is an alkyl group of 11 carbon atoms) and $C_{14}$ acyl sarcosinate (i.e. an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

It has been obseryed that further improved stain removal performance is achieved with a surfactant system comprising a hydrophilic nonionic surfactant and a hydrophobic nonionic surfactant as well as a further hydrophilic surfactant like a polyhydroxy fatty acid amide surfactant and/or an alkyl ethoxylated sulphate.

The bleaching compositions of the present invention may further comprise an amine oxide surfactant according to the formula R1R2R3NO, wherein each of R1, R2 and R3 is independently a $C_1$–$C_{30}$, preferably a $C_1$–$C_{20}$, most preferably a $C_1$–$C_{16}$ hydrocarbon chain.

In the embodiment of the present invention where the compositions are formulated as emulsions said compositions are opaques. In centrifugation examination, it was obseryed that said emulsions herein showed no phase separation after 15 minutes at 6000 rpm. Under microscopic examination, said emulsions appeared as a dispersion of droplets in a matrix.

In the embodiment of the present invention where the compositions are formulated as microemulsions said compositions are macroscopically transparent in the absence of opacifiers and dyes. In centrifugation examination, it was obseryed that said microemulsions herein showed no phase separation after 15 minutes at 6000 rpm. Under microscopic examination, said microemulsions appeared as a dispersion of droplets in a matrix. We have obseryed that the particles had a size which is typically around or below 3 micron diameter, preferably below 2 micron diameter. In a preferred embodiment of the emulsions of the present invention wherein the emulsions further comprise a non-water soluble ingredient to emulsify like a bleach activator as described hereinafter, the emulsifying system meets the equation:

$$HLB(X) = \frac{\text{weight\% } A}{100} \times HLB(A) + \frac{\text{weight\% } B}{100} \times HLB(B) \text{ and}$$

$$\text{weight\% } A + \text{weight\% } B = 100\%;$$

where HLB (X) refers to the HLB of the ingredient to emulsify, if several ingredients are present to emulsify X refers to all of them (weighted average based on % of each ingredient in the formula), HLB (A) refers to the HLB of the hydrophilic surfactant, or mixtures thereof, and HLB (B) refers to the HLB of the hydrophobic surfactant, or mixtures thereof.

In a particularly preferred embodiment of the emulsions of the present invention, wherein the emulsions may further comprise a bleach activator like acetyl triethyl citrate, an adequate surfactant system, would comprise a hydrophobic nonionic surfactant with for instance an HLB of 6, such as a Dobanol$^R$ 23-2 and a hydrophilic nonionic surfactant with for instance an HLB of 15, such as a Dobanol$^R$ 91-10. Other suitable nonionic surfactant systems comprise for example a Dobanol$^R$ 23-6.5 (HLB about 12) and a Dobanol$^R$ 23 (HLB below 6) or a Dobanol$^R$ 45-7 (HLB=11.6) and a Dobanol 23-3 (HLB=8.1).

The bleaching compositions of the present invention formulated in the form of emulsions or microemulsions are chemically stable. By "chemically stable" it is meant herein that said compositions of the present invention comprising a peroxygen bleach do not undergo more than 10% available oxygen loss at 50° C. in 2 weeks. The concentration of available oxygen can be measured by chemical titration methods known in the art, such as the iodimetric method, the permanganometric method and the cerimetric method. Said methods and the criteria for the choice of the appropriate method are described for example in "Hydrogen Peroxide" , W. C. Schumb, C. N. Satterfield and R. L. Wentworth, Reinhold Publishing Corporation, New York, 1955 and "Organic Peroxides", Daniel Swern, Editor Wiley Int. Science, 1970. Alternatively, the stability of said compositions may also be evaluated by a bulging test method. Accordingly, said bleaching compositions of the present invention may be packaged in a given deformable container/bottle without compromising the stability of said container/bottle comprising it upon standing, for long periods of time.

The liquid compositions of the present invention formulated either as an emulsion or microemulsion are typically aqueous and are formulated in the acidic pH range up to 6, preferably at a pH of from 1 to 5, more preferably of from 2 to 5 and most preferably from 3 to 5. Formulating the compositions of the present invention in the acidic pH range contributes to the stability of said compositions. The pH of the compositions of the present invention can be adjusted by using organic or inorganic acids.

Optionals

The compositions of the present invention may further comprise optional ingredients like bleach activators, stabilisers, chelating agents, radical scavengers, builders, soil suspenders, dye transfer agents, solvents, brighteners, perfumes, foam suppressors or dyes or mixtures thereof.

As an optional but highly preferred ingredient, the compositions of the present invention comprise a bleach activator or mixtures thereof. By "bleach activator", it is meant herein a compound which reacts with hydrogen peroxide to form a peracid. The peracid thus formed constitutes the activated bleach. Paticularly suitable bleach activators to be used herein are hydrophobic bleach activators, i.e., a bleach activator which is not substantially and stably miscible with water. Typically, such hydrophobic bleach activators have a secondary HLB (hydrophilic lipophilic balance) below 11, preferably below 10. Secondary HLB is known to those skilled in the art and is defined for example in "Emulsions theory and practice" by P. Becher, Reinhold, New York, 1957, or in "Emulsion science" by P. Sherman, Academic Press, London, 1969.

Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition.

The compositions according to the present invention may comprise from 0.01% to 20% by weight of the total composition of said bleach activator, or mixtures thereof, preferably from 1% to 10%, and more preferably from 3% to 7%.

Suitable chelating agents to be used herein include chelating agents selected from the group of phosphonate chelating agents, amino carboxylate chelating agents, polyfunctionally-substituted aromatic chelating agents, and further chelating agents like glycine, salicylic acid, aspartic acid, glutamic acid, malonic acid, or mixtures thereof. Chelating agents when used, are typically present herein in amounts ranging from 0.001% to 5% by weight of the total composition and preferably from 0.05% to 2% by weight.

Suitable phosphonate chelating agents to be used herein may include ethydronic acid as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred amino phosphonate chelating agents to be used herein are diethylene triamine penta methylene phosphonates. Such phosphonate chelating agents are commercially available from Monsanto under the trade name DEQUESTO®.

The most preferred phosphonate chelating agent to be used herein is aminotri(methylene phosphonic acid), herein referred to as ATMP. Indeed, it has been found that the addition of ATMP, i.e. the compound of formula

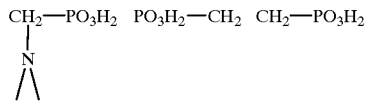

in a liquid composition of the present invention considerably reduces the damage otherwise associated with the pretreatment of fabrics with peroxygen bleach-containing compositions, especially those fabrics which contain metal ions, such as copper, iron, chromium, and manganese.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4, 704, 233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Another preferred chelating agent for use herein is of the formula:

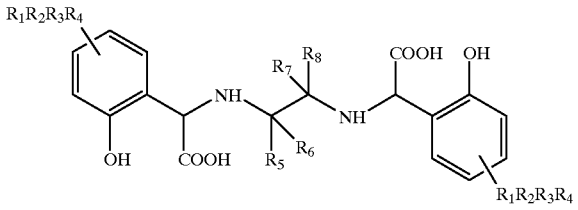

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are ATMP, diethylene triamine methylene phosphonate, ethylene N,N'-disuccinic acid, diethylene triamine pantaacetate, glycine, salicylic acid, aspartic acid, glutamic acid, malonic acid or mixtures thereof and highly preferred is ATMP.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Radical scavengers when used, are typically present herein in amounts ranging from 0.001% to 2% by weight of the total composition and preferably from 0.001% to 0.5% by weight.

The presence of chelating agents, especially ATMP, and/or radical scavengers allows to contribute to the safety profile of the compositions of the present invention suitable for pretreating a soiled colored fabric upon prolonged contact times before washing said fabric.

The compositions of the present invention may further comprise up to 20%, preferably from 2% to 10% by weight of the total composition of a solvent or mixtures thereof. More particularly, it has been found that the addition of a solvent system comprising at least one hydrophobic solvent and at least one hydrophilic solvent, in a liquid composition according to the present invention, further contributes to the benefits of said composition, i.e., further improves the overall stain removal performance on various type of stains including greasy stains, enzymatic stains as well as bleachable stains.

Suitable hydrophobic solvents to be used herein include terpenes like mono-and bicyclic monoterpenes, especially those of the hydrocarbon class, which include the terpinenes, terpinolenes, limonenes and pinenes and mixtures thereof. Highly preferred materials of this type are d-limonene, dipentene, alpha-pinene and/or beta-pinene. Other hydrophobic solvents include all type of paraffins, both linear and not, containing from 2 to 20 carbons, preferably from 4 to 10, more preferably from 6 to 8. Preferred herein is octane. Another hydrophobic solvent suitable to be used herein is benzyl alcohol. Particularly preferred hydrophobic solvents to be used herein include d-limonene, dipentene, alpha-pinene, beta-pinene, octane, benzyl alcohol, or mixtures thereof.

Suitable hydrophilic solvents to be used herein include alkoxylated aliphatic alcohols like methoxy propanol, ethoxy propanol, propoxy propanol, buthoxy propanol as well as alkoxylated glycols like ethoxy-ethoxy-ethanol, aliphatic or aromatic alcohols like ethanol, propanol, as well as glycols like propanediol or mixtures thereof.

Any polymeric soil release agent known to those skilled in the art can optionally be employed in the compositions and processes of this invention. Polymeric soil release agents are characterized by having both hydrophilic segments, to hydrophilize the surface of hydrophobic fibres, such as polyester and nylon, and hydrophobic segments, to deposit upon hydrophobic fibres and remain adhered thereto through completion of washing and rinsing cycles and, thus, serye as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropyiene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units which contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,41 5,807, issued May 16, 1995, to Gosselink et al.

If utilized, soil release agents will generally comprise from about 0.01% to about 10.0%, by weight, of the detergent compositions herein, typically from about 0.1% to about 5%, preferably from about 0.2% to about 3.0%.

The compositions of the present invention may also include one or more materials effective for inhibiting the transfer of dyes from one dyed surface to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

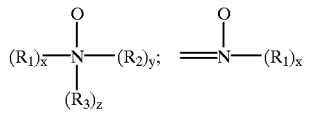

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups.

The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO". The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., Chemical Analysis, Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions may also employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

If high sudsing is desired, suds boosters such as $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, for example, 0.1%–2%, to provide additional suds and to enhance grease removal performance.

Any optical brighteners, fluorescent whitening agents or other brightening or whitening agents known in the art can be incorporated in the instant compositions when they are designed for fabric treatment or laundering, at levels typically from about 0.05% to about 1.2%, by weight, of the detergent compositions herein. Commercial optical brighteners which may be useful in the present invention can be classified into subgroups, which include, but are not necessarily limited to, derivatives of stilbene, pyrazoline, coumarin, carboxylic acids, methinecyanines, dibenzothiophene-5,5-dioxide, azoles, 5- and 6-membered-ring heterocyclic brighteners, this list being illustrative and non-limiting. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-styryl-phenyl)-2H-naphthol[1,2-d]triazoles; 4,4'-bis-(1,2,3-triazol-2-yl)-stil-benes; 4,4'-bis(styryl)bisphenyls; and the aminocoumarins. Specific examples of these brighteners include 4-methyl-7-diethyl- amino coumarin; 1,2-bis(-benzimidazol-2-yl)ethylene; 2,5-bis(benzoxazol-2-yl) thiophene; 2-styryl-napth-[1,2-d]oxazole; and 2-(stilbene-4-yl)-2H-naphth- [1,2-d]triazole. See also U.S. Pat. No. 3,646,015, issued Feb. 29, 1972 to Hamilton. Anionic brighteners are typically preferred herein.

Although the preferred application of the compositions described herein is laundry pretreatment as described hereinbefore, the compositions of the present invention may also be used as a laundry detergent or as a laundry detergent booster and as a household cleaner in the bathroom or in the kitchen.

The compositions of the present invention suitable for pretreating fabrics can be packaged in a variety of containers including conventional bottles, bottles equipped with roll-on, sponge, brusher or sprayers.

The present invention will be further illustrated by the following examples.

EXAMPLES

The following compositions were made by mixing the listed ingredients in the listed proportions (weight % unless otherwise specified).

| Compositions | I | II | III | IV | V | VI |
|---|---|---|---|---|---|---|
| Dobanol ® 45-7 | 6.4 | 6.4 | 6.4 | 1.5 | 12.0 | 6.0 |
| Dobanol ® 23-3 | 8.6 | 8.6 | 8.6 | — | — | 6.0 |
| Dobanol ® 23-6.5 | — | — | — | 1.5 | — | — |
| C25-AE-2.5-S | 4.0 | 4.0 | 4.0 | 1.5 | 12.0 | 6.0 |
| Alkyl glucose amide | 2.0 | 2.0 | 2.0 | — | — | — |
| ATC* | 3.5 | 3.5 | 3.5 | — | 3.5 | — |
| $H_2O_2$ | 4.0 | 4.0 | 4.0 | — | 6.0 | 4.0 |
| Dilauroyl peroxide | 0.5 | — | — | 1.0 | — | 2.0 |
| Ethoxylated 15-18 tetraethylenepentamine | 0.5 | 0.5 | 0.5 | 0.2 | 1.0 | 0.7 |
| Limonene D(+) | — | — | 0.5 | 0.1 | 0.5 | 1.0 |
| Benzoyl alcohol | — | — | 2.0 | 1.0 | — | — |
| 1-methoxy-2 propanol | — | — | 5.0 | — | 2.0 | 3.0 |
| ATMP** | 0.2 | 0.1 | — | — | 0.16 | — |
| Water and minors | | | up to 100% | | | |
| H2SO4 up to pH 4 | | | | | | |

*ATC is acetyl triethyl citrate.
Dobanol ® 23-3 is a C12-C13 nonionic ethoxylated surfactant with HLB of 8.1.
Dobanol ® 23-6.5 is a C12-C13 nonionic ethoxylated surfactant with HLB of 11.9.
Dobanol ® 45-7 is a C14-C15 nonionic ethoxylated surfactant with HLB of 11.6.
**ATMP is aminotri(methylene phosphonic acid).

Excellent stain removal performance is obtained on a variety of stains including greasy/oily stains like clay, dirty motor oil, make-up, lipstick, carotenoid-type stains like spaghetti sauce, bleachable stains like tea and enzymatic stains like grass, blood, when pretreating soiled fabrics with any of the compositions I to VI, as described above, e.g., when leaving such a composition to act onto the fabrics for a contact period of about 5 minutes, before rinsing said fabrics with water or washing with a conventional detergent composition like Tide® powder at a dilution level of , for example, 1 to 400.

What is claimed is:

1. A process of bleaching a fabric with a liquid composition having a pH from 1 to 5 comprising from 0.01% to 15% by weight of the total composition of peroxygen bleach, and a soil dispersing agent which is an ethoxylated amine polymer of the formula:

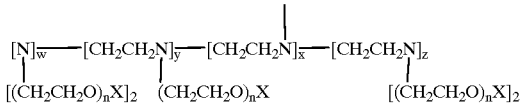

whereas X is a Hydrogen; w is 1 or 0; x+y+z is at least 2, y+z is at least 2; and n is at least 3; said polymer selected from the group consisting of ethoxylated polyethyleneamines having a molecular weight of from 140 to 310 prior to ethoxylation and ethoxylated polyethyleneimines having a molecular weight of 600 to 1800 prior to ethoxylation, said process comprising the step of applying said composition in its neat form onto at least a portion of the fabric, before said fabric is washed.

2. A process according to claim 1 wherein said composition is allowed to remain in contact with said fabric from 1 minute to 1 hour, before said fabric is washed.

3. A process according to claim 2 wherein said composition is allowed to remain in contact with said fabric from 1 minute to 30 minutes, before said fabric is washed.

4. A process according to claim 2 wherein said composition is allowed to remain in contact with said fabric from 2 minutes to 10 minutes, before said fabric is washed.

5. A process according to claim 1, wherein said peroxygen bleach is hydrogen peroxide or a water-soluble source thereof selected from the group consisting of percarbonate, persilicate, persulphate, perborate, peroxyacids, hydroperoxides, diacyl peroxides and mixtures thereof.

6. A process according to claim 1 wherein said composition comprises from 0.1% to about 12% by weight of the total composition of said peroxygen bleach, or mixtures thereof.

7. A process according to claim 1 wherein said composition comprises from 0.5% to 10% by weight of the total composition of said peroxygen bleach, or mixtures thereof.

8. A process according to claim 1 wherein said composition comprises from 0.01% to 20% by weight of the total composition of said soil dispersing agent, or mixtures thereof.

9. A process according to claim 8 wherein said composition comprises from 0.1% to 10% by weight of the total composition of said soil dispersing agent, or mixtures thereof.

10. A process according to claim 8 wherein said composition comprises from 0.2% to about 4% by weight of the total composition of said soil dispersing agent, or mixtures thereof.

11. A process according to claim 1 wherein said composition further comprises a bleach activator or mixtures thereof.

12. A process according to claim 2 wherein said composition comprises said bleach activator or mixtures thereof, at a level of from 0.01% to 20% by weight of the total composition.

13. A process according to claim 12 wherein said composition comprises said bleach activator or mixtures thereof at a level of from 1% to 10% by weight of the total composition.

14. A process according to claim 12 wherein said bleach activator is selected from the group consisting of acetyl triethyl citrate, tetracetyl ethylene diamine, sodium 3,5,5 trimethyl hexanoyloxybenzene sulphonate, diperoxy dodecanoic acid, nonylamide of peroxyadipic acid, n-nonanoyloxybenzenesulphonate, N-acyl caprolactam, substituted and unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam, pentanoyl caprolactam and mixtures thereof.

* * * * *